US010797446B2

(12) United States Patent
Liu et al.

(10) Patent No.: US 10,797,446 B2
(45) Date of Patent: Oct. 6, 2020

(54) ELECTRICAL ASSEMBLY COMPOSED OF RECEPTACLE CONNECTOR AND PLUG CONNECTOR

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Hong-Wei Liu, Kunshan (CN); Wei Zhong, Kunshan (CN); Jian-Kuang Zhu, Kunshan (CN)

(73) Assignees: FOXCONN (KUNSHAN) COMPUTER CONNECTOR CO., Kunchan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/583,238

(22) Filed: Sep. 25, 2019

(65) Prior Publication Data

US 2020/0106217 A1 Apr. 2, 2020

(30) Foreign Application Priority Data

Sep. 29, 2018 (CN) ..... 2018 2 1597320 U

(51) Int. Cl.

| | |
|---|---|
| ***H01R 13/6581*** | (2011.01) |
| ***H01R 13/26*** | (2006.01) |
| ***H01R 13/405*** | (2006.01) |
| ***H01R 13/631*** | (2006.01) |

(52) U.S. Cl.

CPC ..... *H01R 13/6581* (2013.01); *H01R 13/26* (2013.01); *H01R 13/405* (2013.01); *H01R 13/631* (2013.01)

(58) Field of Classification Search

CPC .. H01R 13/6581; H01R 13/26; H01R 13/405; H01R 13/631

See application file for complete search history.

(56) References Cited

U.S. PATENT DOCUMENTS 6,241,556 B1 * 6/2001 Chih ..... H01R 12/7047 439/607.01
6,416,360 B1 * 7/2002 Zhang ..... H01R 13/506 439/607.36

(Continued)

*Primary Examiner* — Abdullah A Riyami
*Assistant Examiner* — Nader J Alhawamdeh
(74) *Attorney, Agent, or Firm* — Wei Te Chung; Ming Chieh Chang

(57) ABSTRACT

An electrical assembly is composed of a receptacle connector and a plug connector adapted to be mated with each other. The plug connector includes an elongated insulative housing forming a receiving space rearwardly recessed from a front mating face thereof with a pair of forwardly extending guiding posts respectively located at two opposite longitudinal ends of said receiving space in the longitudinal direction. A plurality of contacts are disposed in the housing with corresponding contacting sections exposed in the receiving space. A metallic shield is rearwardly assembled upon the housing from a front side of the housing with a pair of bending sections each inserted into the corresponding retaining recess which is terminated behind the front mating face in the front-to-back direction.

18 Claims, 13 Drawing Sheets

(56) References Cited

U.S. PATENT DOCUMENTS

| | | | | |
|---|---|---|---|---|
| 6,645,007 | B1 * | 11/2003 | Ko | H01R 9/0527 439/579 |
| 6,755,687 | B1 * | 6/2004 | Ko | H01R 4/024 439/579 |
| 6,796,839 | B1 * | 9/2004 | Wu | H01R 13/658 439/607.01 |
| 6,830,478 | B1 * | 12/2004 | Ko | H01R 13/6275 439/579 |
| D517,489 | S | 3/2006 | Jae | |
| D517,490 | S | 3/2006 | Jae | |
| 7,686,628 | B2 * | 3/2010 | Lino | H01R 43/0256 439/108 |
| 7,993,161 | B2 * | 8/2011 | Mao | H01R 12/7052 439/607.4 |
| 9,281,583 | B2 * | 3/2016 | Yuan | H01R 12/71 |
| 9,444,203 | B2 * | 9/2016 | Zhong | H01R 24/66 |
| 2014/0308826 | A1 * | 10/2014 | Yuan | H01R 12/71 439/83 |
| 2014/0322980 | A1 * | 10/2014 | Yuan | H01R 13/6471 439/626 |
| 2015/0072559 | A1 * | 3/2015 | Qian | H01R 13/6582 439/607.17 |
| 2017/0170608 | A1 * | 6/2017 | Zhao | H01R 24/60 |

* cited by examiner

ELECTRICAL ASSEMBLY COMPOSED OF RECEPTACLE CONNECTOR AND PLUG CONNECTOR

BACKGROUND OF THE INVENTION

1. Field of the Invention

The present invention relates generally to an electrical assembly, and more particularly to a combination of a receptacle connector and a plug connector adapted to be mated with each other.

2. Description of Related Arts

U.S. D517489 and U.S. D517490 disclose the plug connector and the receptacle connector adapted to be mated together. Notably, the receptacle connector as well as the plug connector has a metallic shield attached upon the elongated housing. Anyhow, attachment between the elongated end wall of the housing and the elongated end section of the shield may tend to be loosened due to repeatedly mating.

It is desired to have a reliable and secure attachment of the elongated end wall of the housing and the elongated end section of the shield which is durable for repeated use.

SUMMARY OF THE INVENTION

An object of the invention is to provide an electrical assembly composed of a receptacle connector and a plug connector adapted to be mated with each other. The plug connector includes an elongated insulative housing forming a receiving space rearwardly recessed from a front mating face thereof with a pair of forwardly extending guiding posts respectively located at two opposite longitudinal ends of said receiving space in the longitudinal direction. A plurality of contacts are disposed in the housing with corresponding contacting sections exposed in the receiving space. A metallic shield is rearwardly assembled upon the housing from a front side of the housing with a pair of bending sections each inserted into the corresponding retaining recess which is terminated behind the front mating face in the front-to-back direction. Correspondingly, the receptacle connector includes an elongated insulative body forming a pair of end towers at two opposite ends with a mating tongue therebetween in the longitudinal direction. A plurality of terminals are disposed in the body with corresponding contacting portions exposed upon the mating tongue. A metallic shell is rearwardly assembled upon the body from a front side of the body with a pair of bending sections each inserted into the corresponding retaining recess in the tower wherein the bending section has an offset free end embedded within the end tower with remainders of the bending section being sidewardly exposed to mating tongue. During a mating process, an inner side region of the bending section of the plug connector intimately confronts the mating tongue of the receptacle connector, and an outer side region of the bending section of the plug connector confronts the bending section of the receptacle connector in the longitudinal direction.

A free end of the bending section has barbed structures.

DETAILED DESCRIPTION OF THE PREFERRED EMBODIMENT

Figure 1:
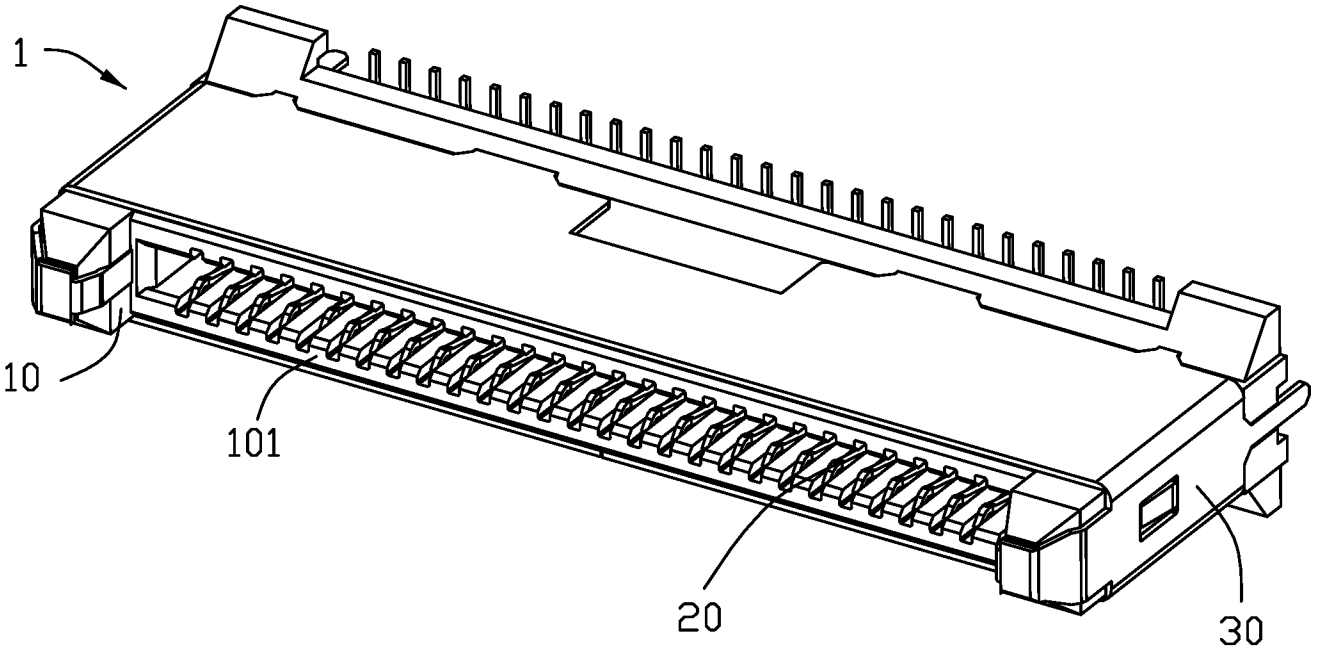
FIG. 1 is a perspective view of a plug connector of an electrical connector assembly according to the invention.
Figure 2:
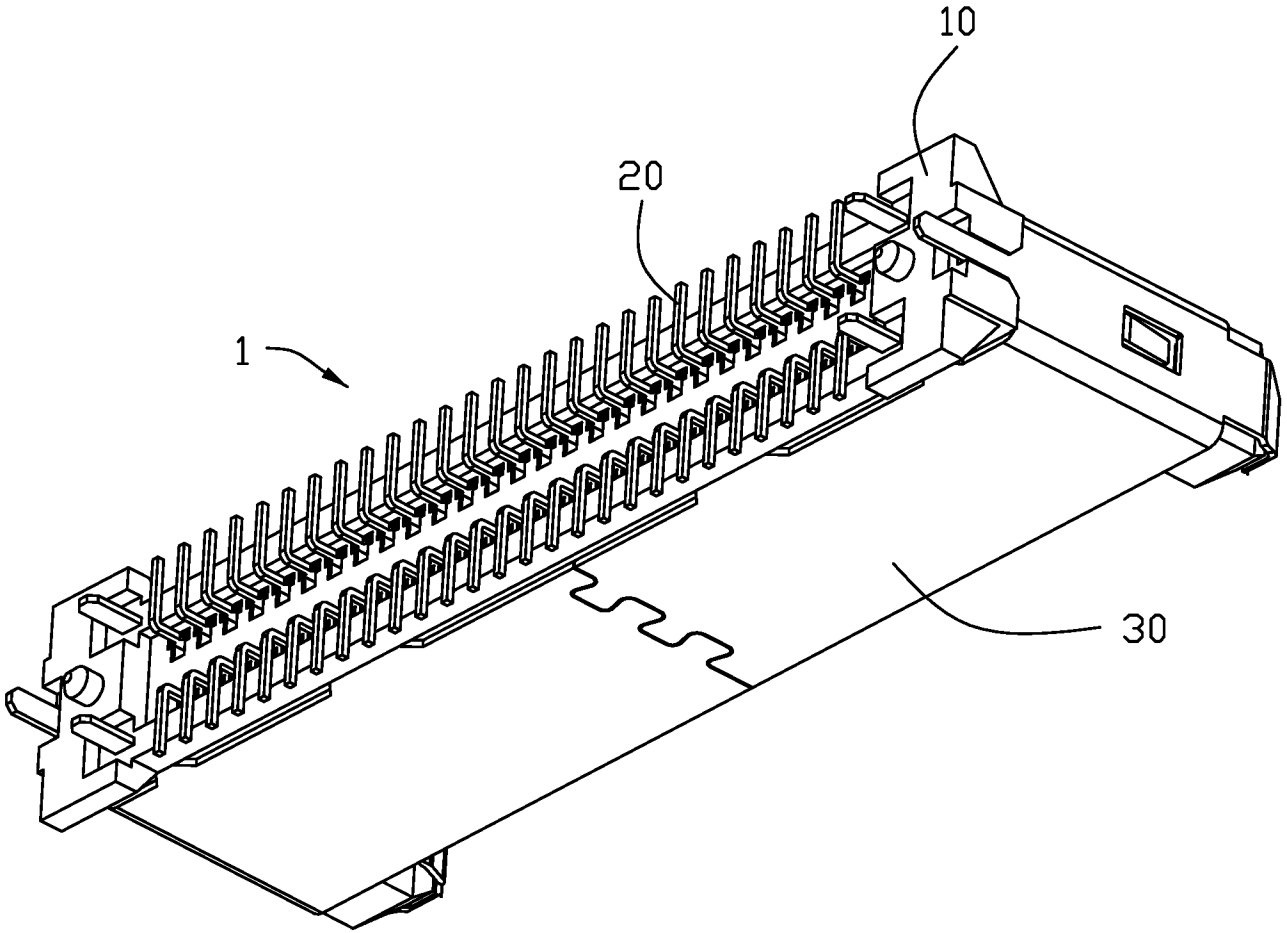
FIG. 2 is another perspective view of the plug connector of the electrical connector assembly of FIG. 1.
Figure 3:
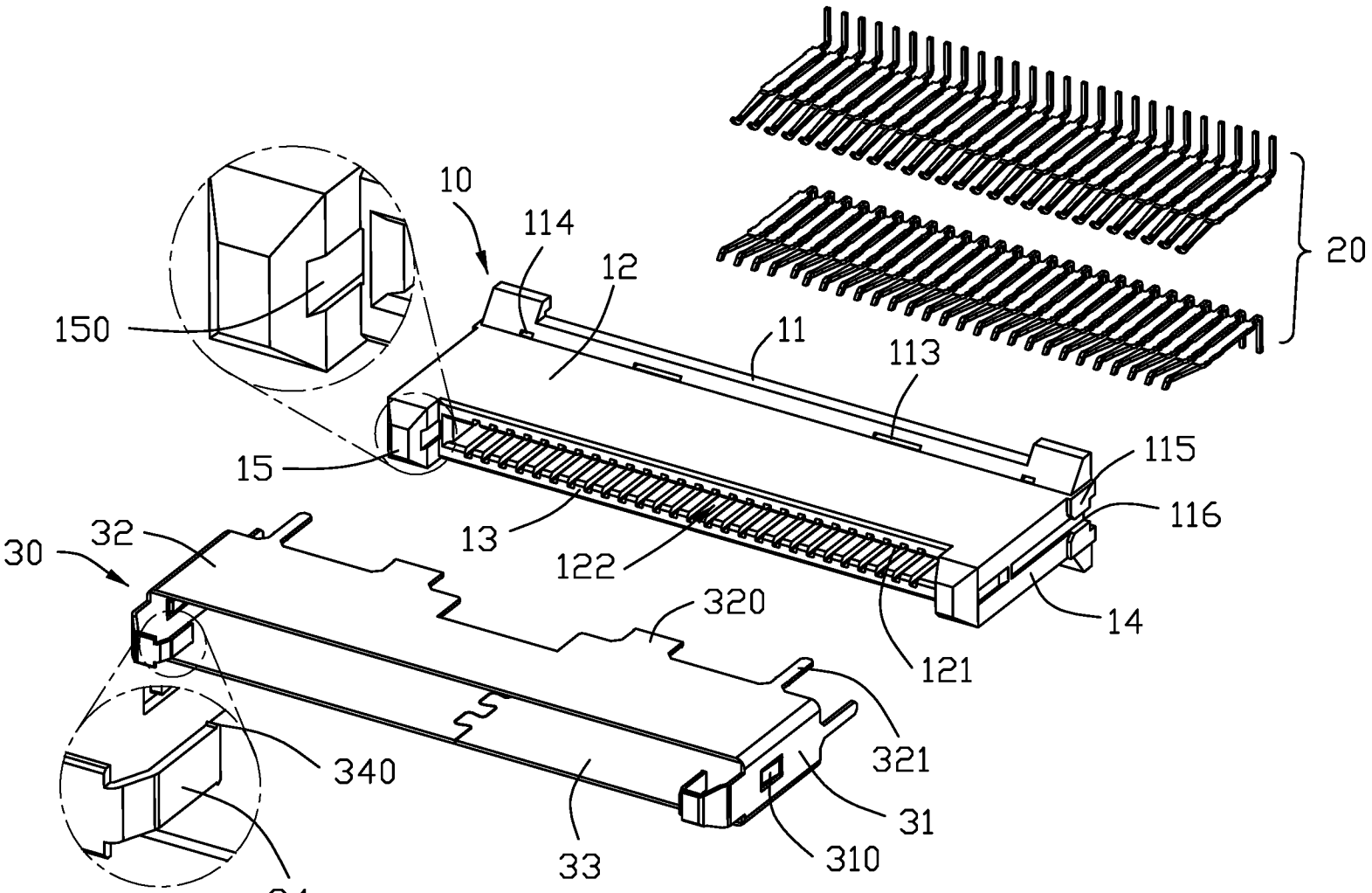
FIG. 3 is an exploded perspective view of the plug connector of the electrical connector assembly of FIG. 1.
Figure 4:
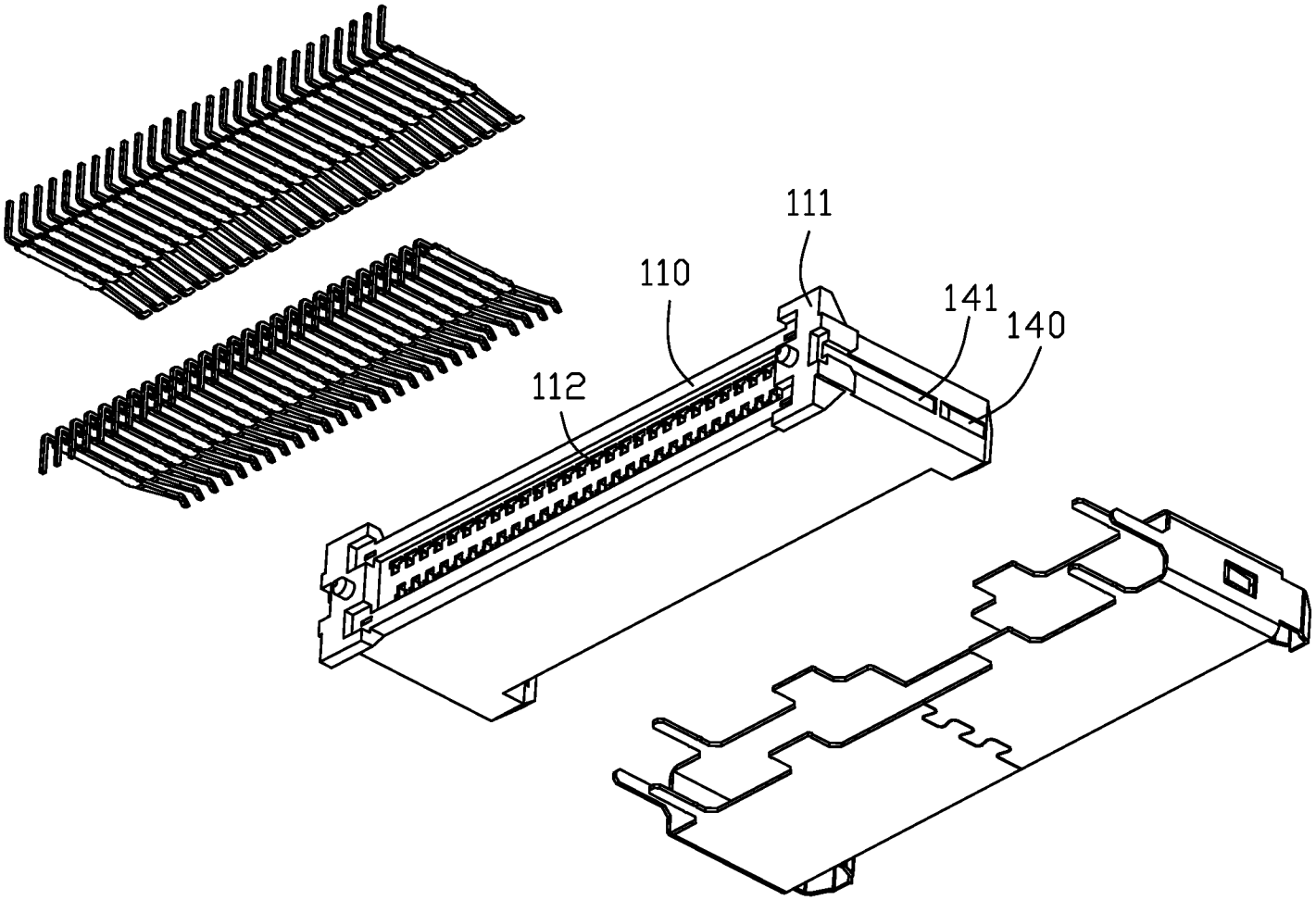
FIG. 4 is another exploded perspective view of the plug connector of the electrical connector assembly of FIG. 3.
Figure 5:
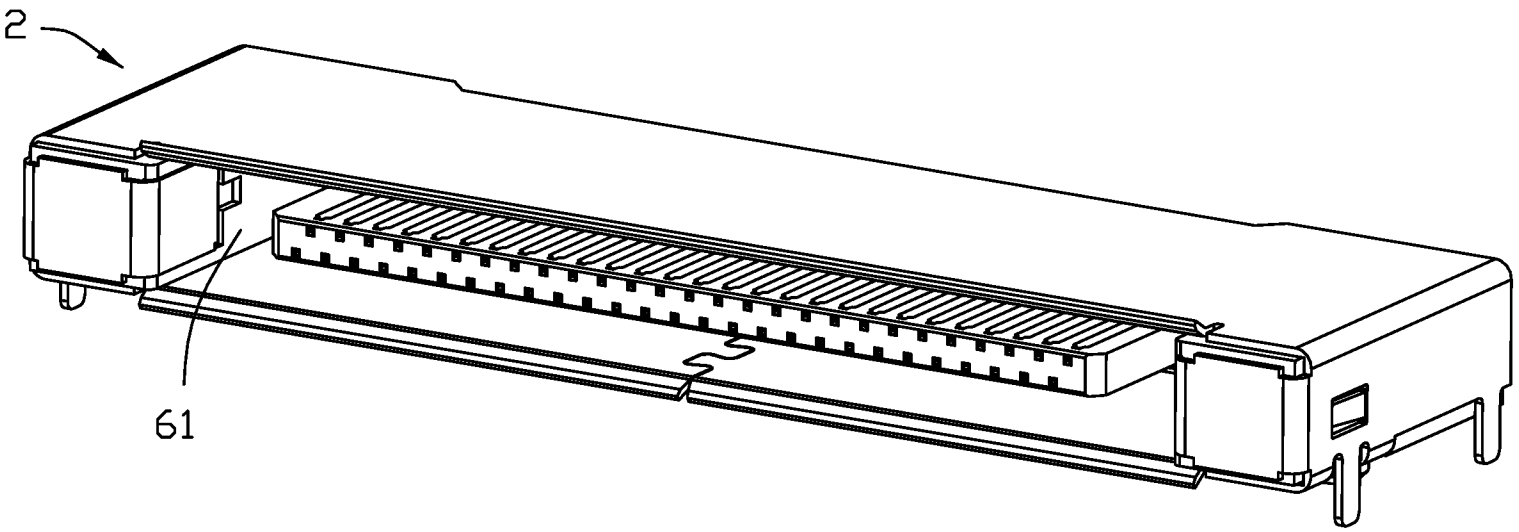
FIG. 5 is a perspective view of a receptacle connector of the electrical connector assembly of FIG. 1.
Figure 6:
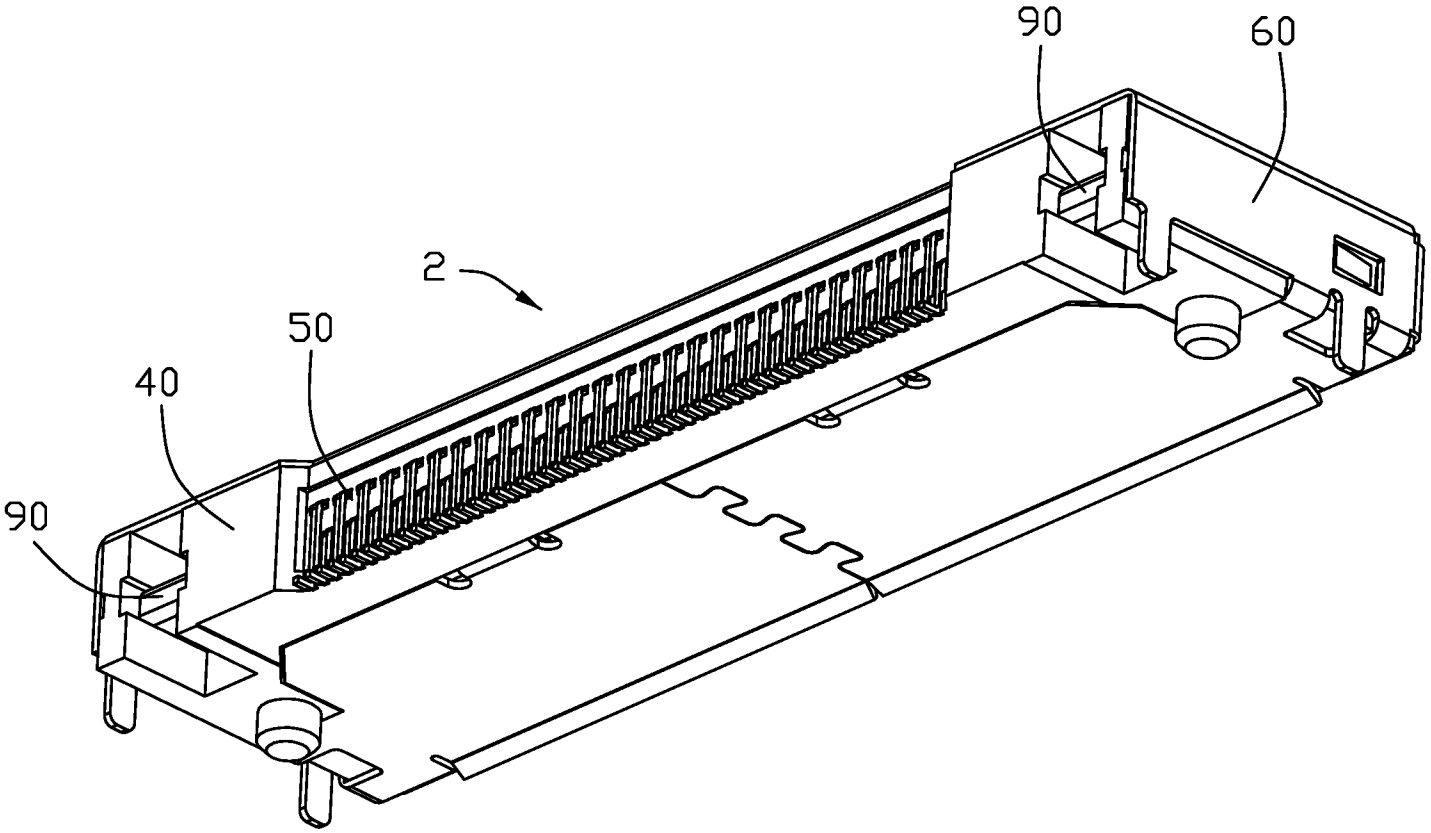
FIG. 6 is another perspective view of a receptacle connector of the electrical connector assembly of FIG. 5.
Figure 7:
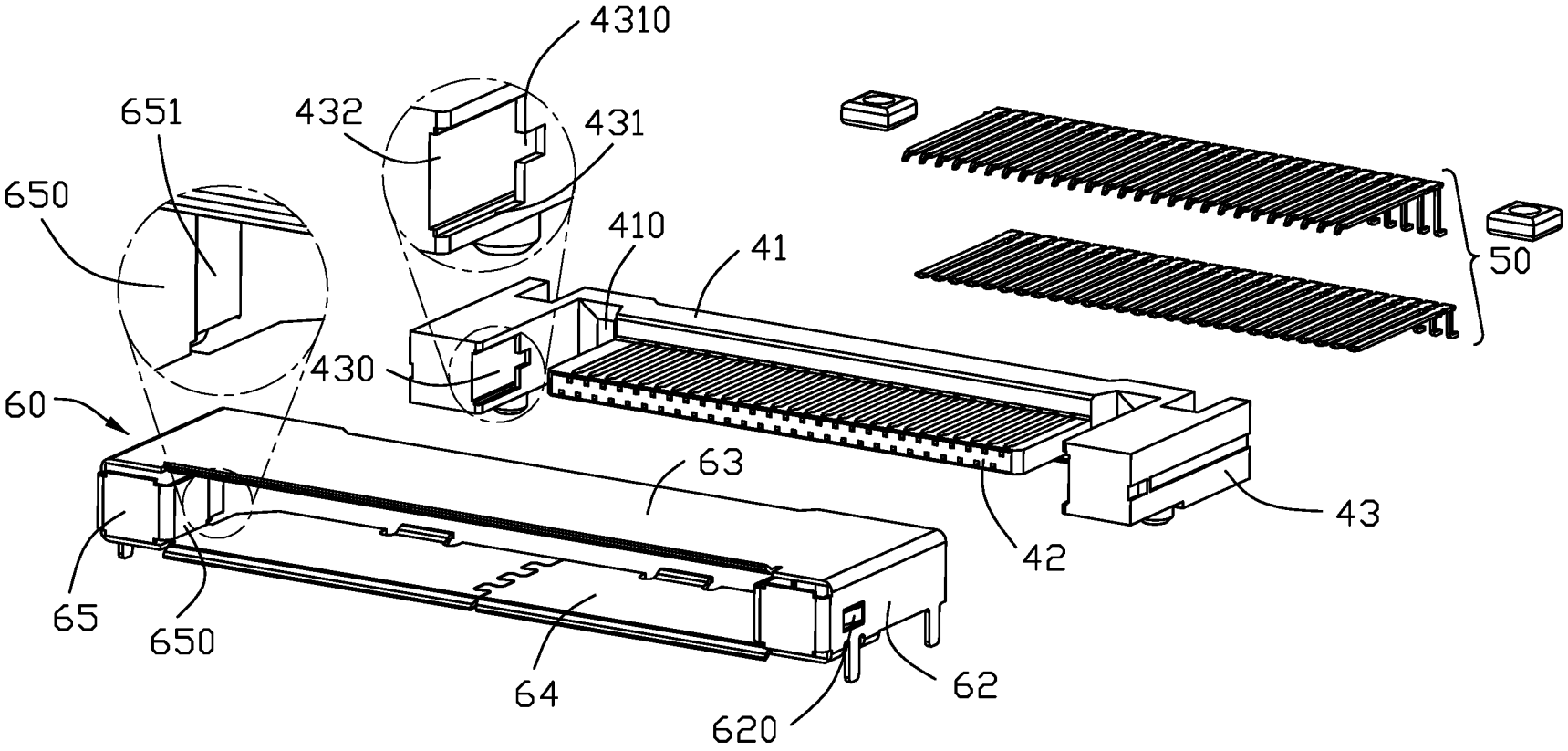
FIG. 7 is an exploded perspective view of a receptacle connector of the electrical connector assembly of FIG. 5.
Figure 8:
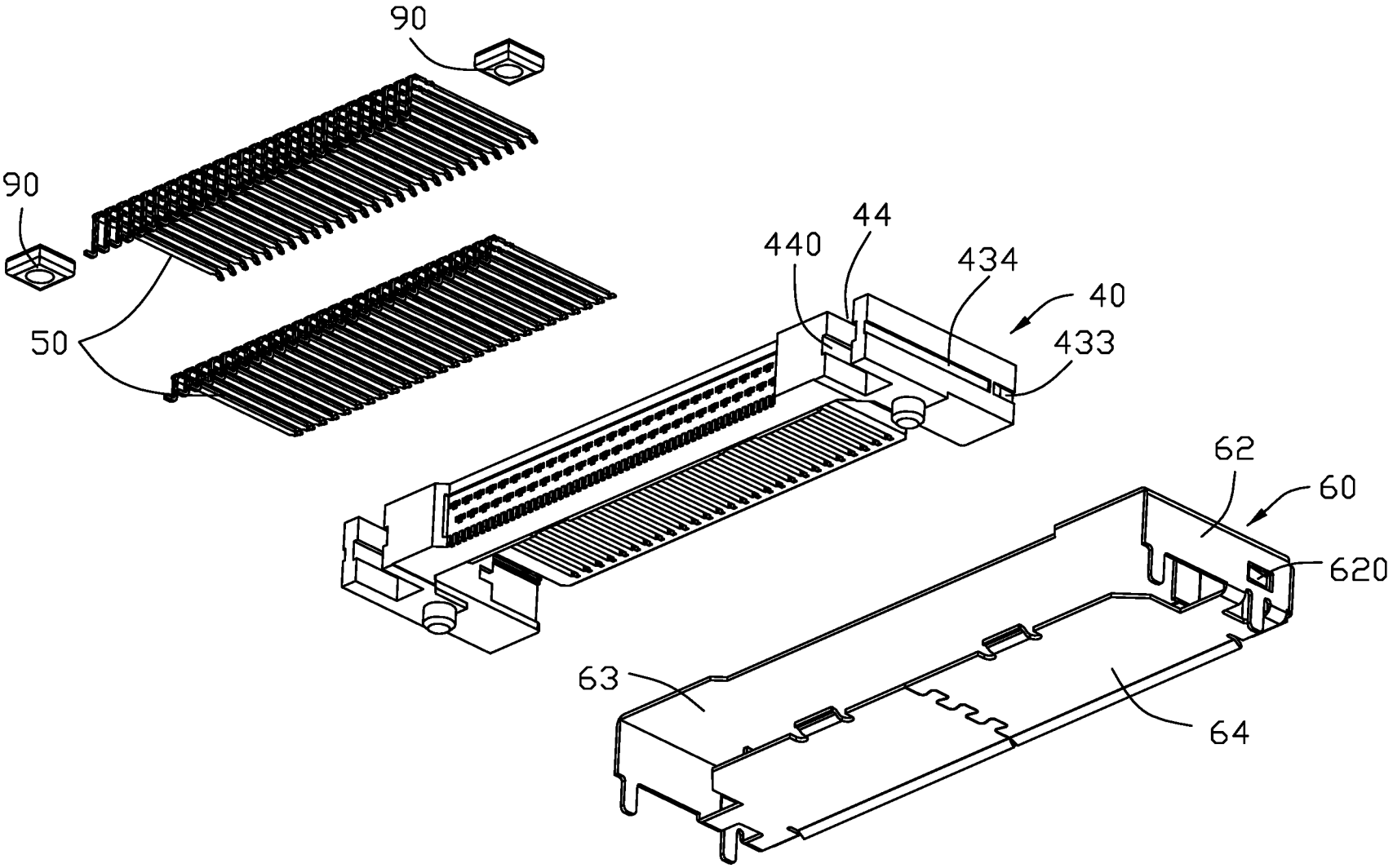
FIG. 8 is another exploded perspective view of a receptacle connector of the electrical connector assembly of FIG. 7.
Figure 9:
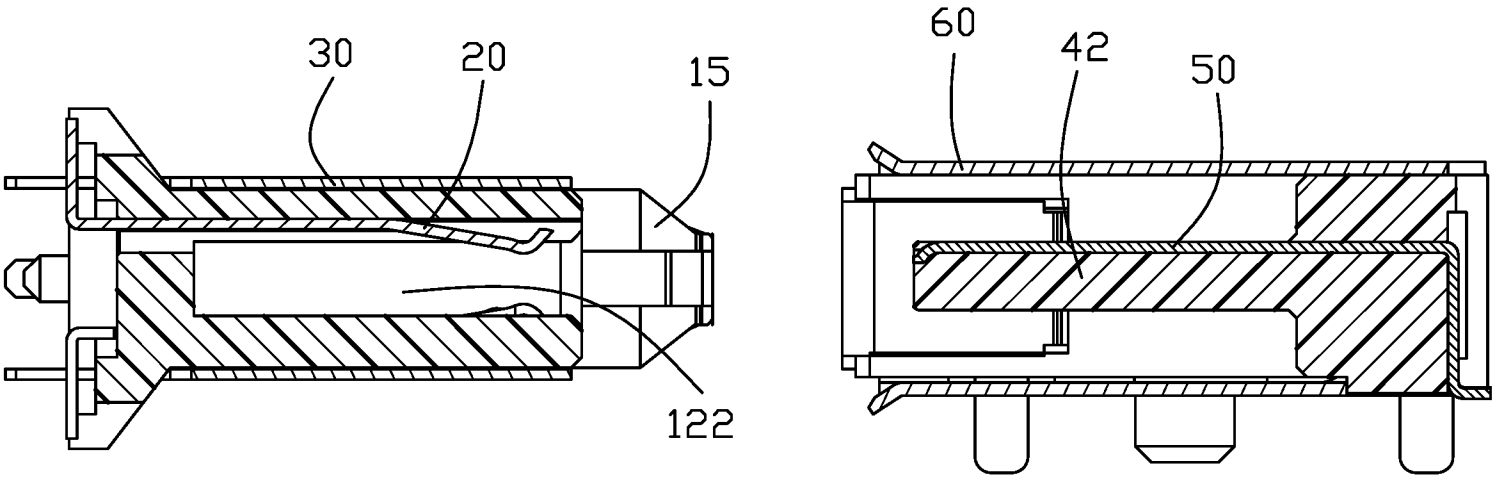
FIG. 9 is a cross-sectional view of the plug connector and the receptacle connector of the electrical connector assembly of FIGS. 1 and 5.
Figure 10:
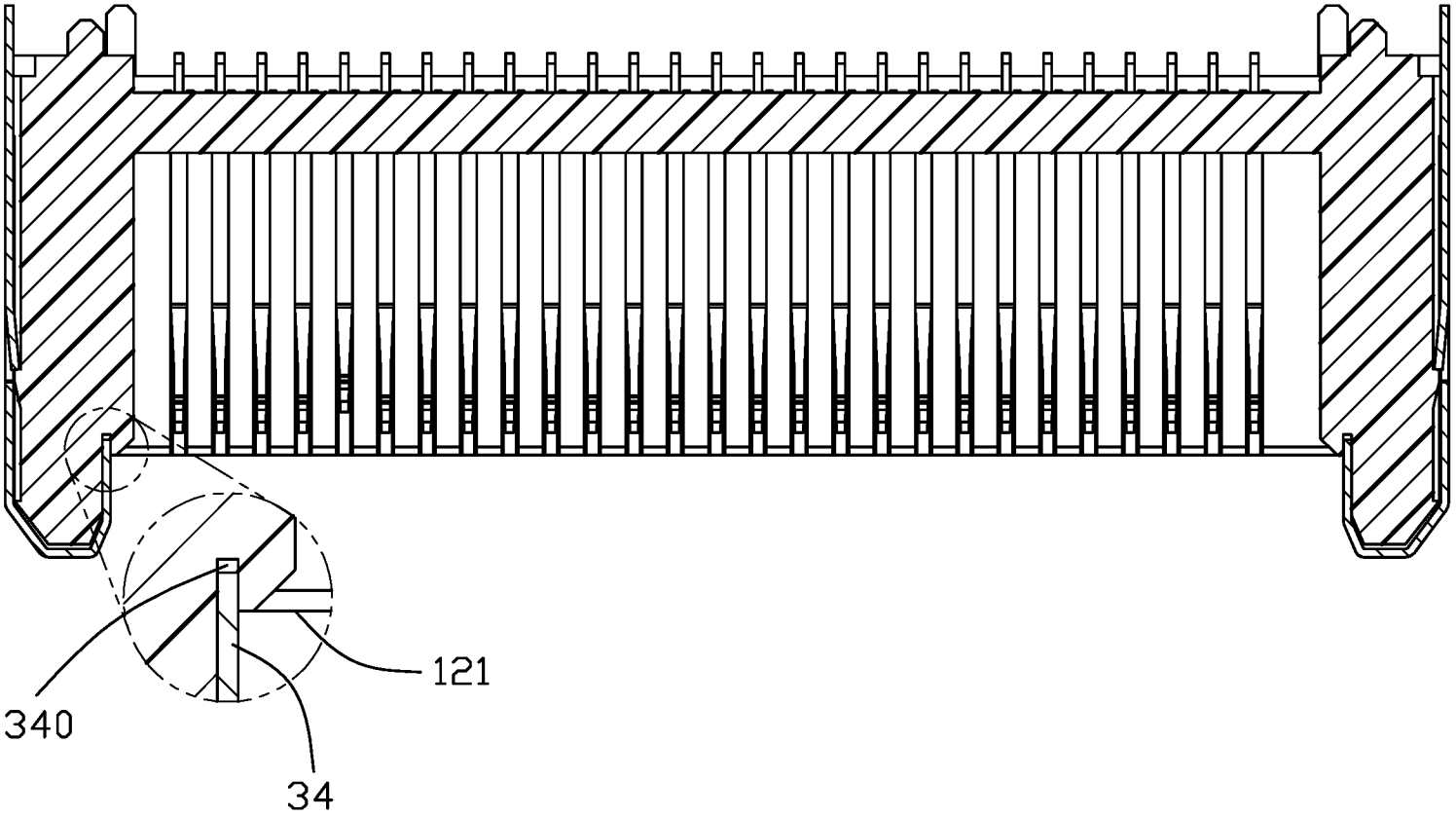
FIG. 10 is a cross-sectional view of the plug connector of the electrical connector assembly of FIG. 1.
Figure 11:
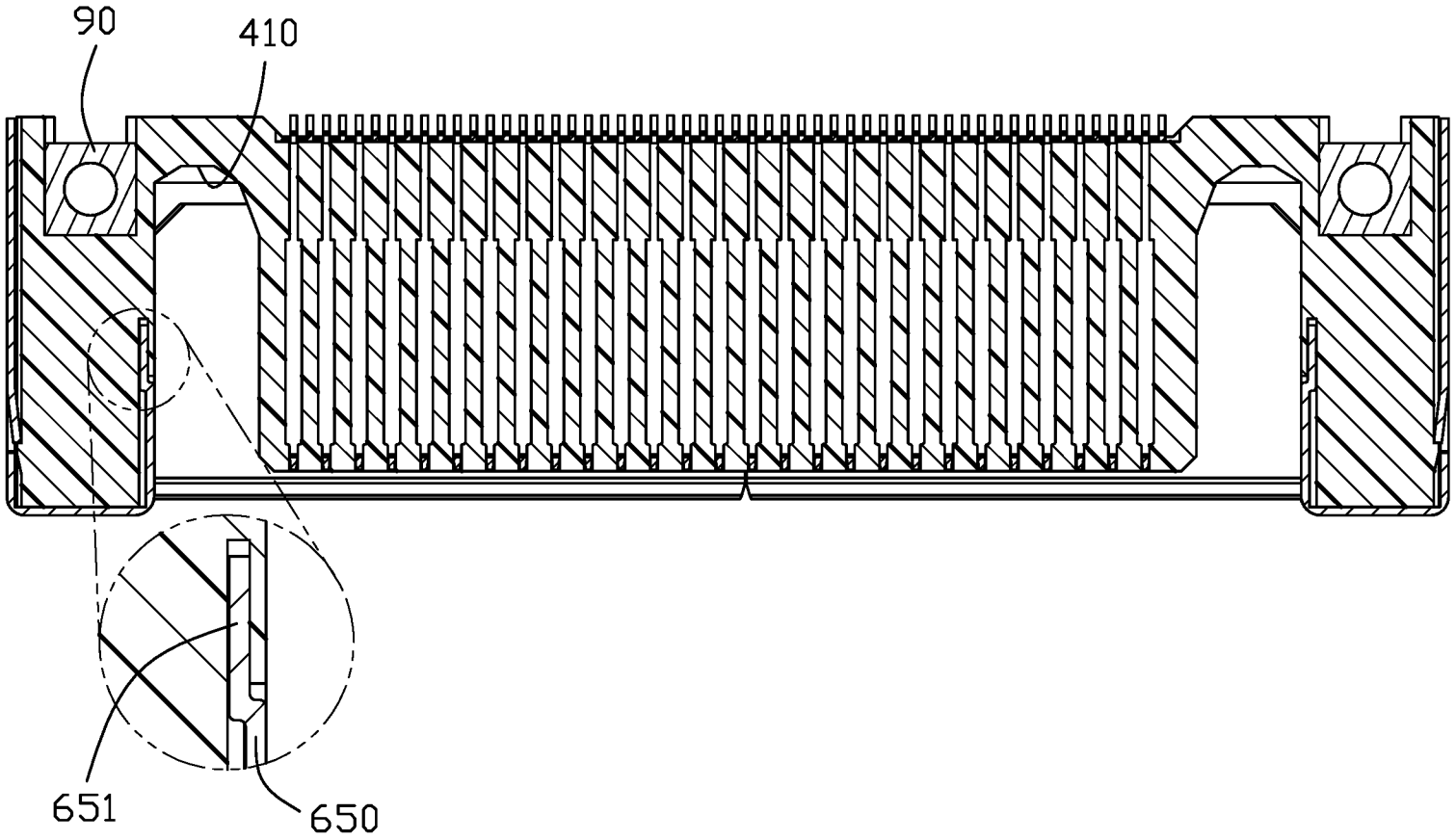
FIG. 11 is a cross-sectional view of the receptacle connector of the electrical connector assembly of FIG. 5.

Referring to FIG. 1-12(B), an electrical connector assembly includes a plug connector 1 and a receptacle connector 2 adapted to be mated with each other. The plug connector 1 includes an insulative housing 10, a plurality of plug contacts 20 retained in the housing 10, and a metallic shield 30 enclosing the housing 10.

The housing 10 includes a (first) base 11, opposite (first) side walls 12 and 13, and a pair of (first) end walls 14 connected between the side walls 12 and 13 to commonly form a receiving space 122. The base 11 includes a seat 110, and a pair of stands 111 at two opposite ends along the longitudinal direction. The base 110 forms a plurality of holes 112 to receive the corresponding contacts 20. The base 11 forms the retaining slits 113 and 114 wherein the retaining slits 113 do not extend through the base 11 in the vertical direction while the retaining slits 114 extend through the base 11 in the vertical direction. A pair of protrusions 115 are formed on each end of the housing 10. A slot 116 is formed between the pair of protrusions 115 in the vertical direction perpendicular to the longitudinal direction. The side walls 12 and 13 form the corresponding passageways for receiving the corresponding contacts 20 and communicatively aligned with the corresponding holes 112. The side walls 12 and 13 further forms a mating face 121. The end wall 14 forms a short groove 140 and a long groove 141, and a guiding post 15 extend forwardly beyond the mating face 121. The guiding post 15 includes opposite inner side region and outer side region, and (first) a recess 150 is formed within the inner side region.

The metallic shield 30 includes opposite (first) end plates 31 attached upon the corresponding end walls 14, and a pair of (first) side plates 32, 33 attached upon the corresponding side walls 12, 13. Each end plate 31 further includes a (first) bending section 34 covering the guiding post 15. The bending section 34 is received within the corresponding recess 150 with barbed structure at a free end for enhancing retention thereof. A (first) spring tang 310 is formed on the end plate 31 to be engaged within the corresponding long groove 141. The end plate 31 further forms a leg (not labeled) extending through the slot 116. The side plates 32, 33 forms retention tabs 320 received within the corresponding slits 113, and mounting legs 321 extending through the corresponding slits 114 wherein the retention tabs 320 forms a barbed structure at a free end for enhancing retention thereof.

The receptacle connector 2 includes an insulative body 40, a plurality of terminals 50 retained in the body 40, and a metallic shell 60 enclosing the body 40.

The body 40 includes a (second) base 41, a mating tongue 42 extending forwardly from the base 41, and a pair of (second) end walls 43. The base 41 forms recessions 410 to receive the corresponding guiding posts 15 therein. The terminals 50 are disposed upon the mating tongue 42. The end wall 43 forms a (second) recess 430 in an interior surface. The recess 430 includes an outer part 431 facing toward the mating tongue 42, and an inner part 432 inside the outer part 431. The outer part 431 has an extending end 4310 behind the main portion of the outer part 431. The end wall 43 forms a long groove 434 and a short groove 433 along the front-to-back direction, and a receiving space 44 with a pair of grooves 440 by two sides to receive the nut.

The metallic shell 60 encloses the body 40 to form a mating cavity 61 in which the mating tongue 42 extends. The shell 60 includes a pair of (second) end plates 62 covering the corresponding end walls 43, and a pair of side plates 63, 64 covering the base 41 and the mating cavity 61. The end plate 62 further includes the (second) bending section 65 to be received within the corresponding recess 430 with barbed structures at a free end for enhancing retention. Notably, the bending section 65 forms an offset arrangement in the longitudinal direction so as to have an outer section 650 disposed in the outer part 431 while an inner section 651 having a free end protectively disposed within the inner part 432. The end wall 62 forms a spring tang 620 for engagement within the long groove 434.

Figure 12A:
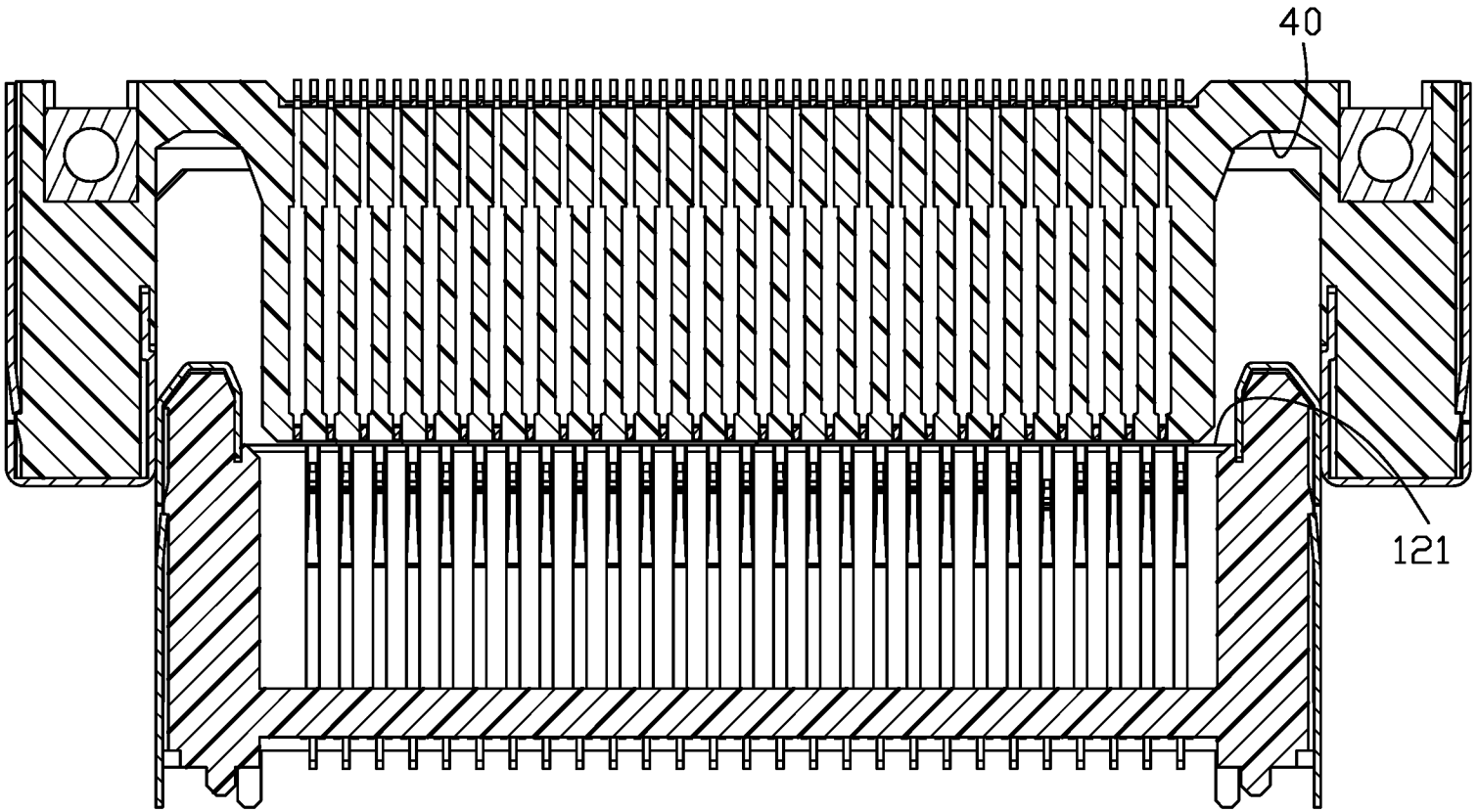
FIG. 12(A) is a cross-sectional view of the plug connector and the receptacle connector of the electrical connector assembly of FIGS. 1 and 6 at an initial stage during mating.
Figure 12B:
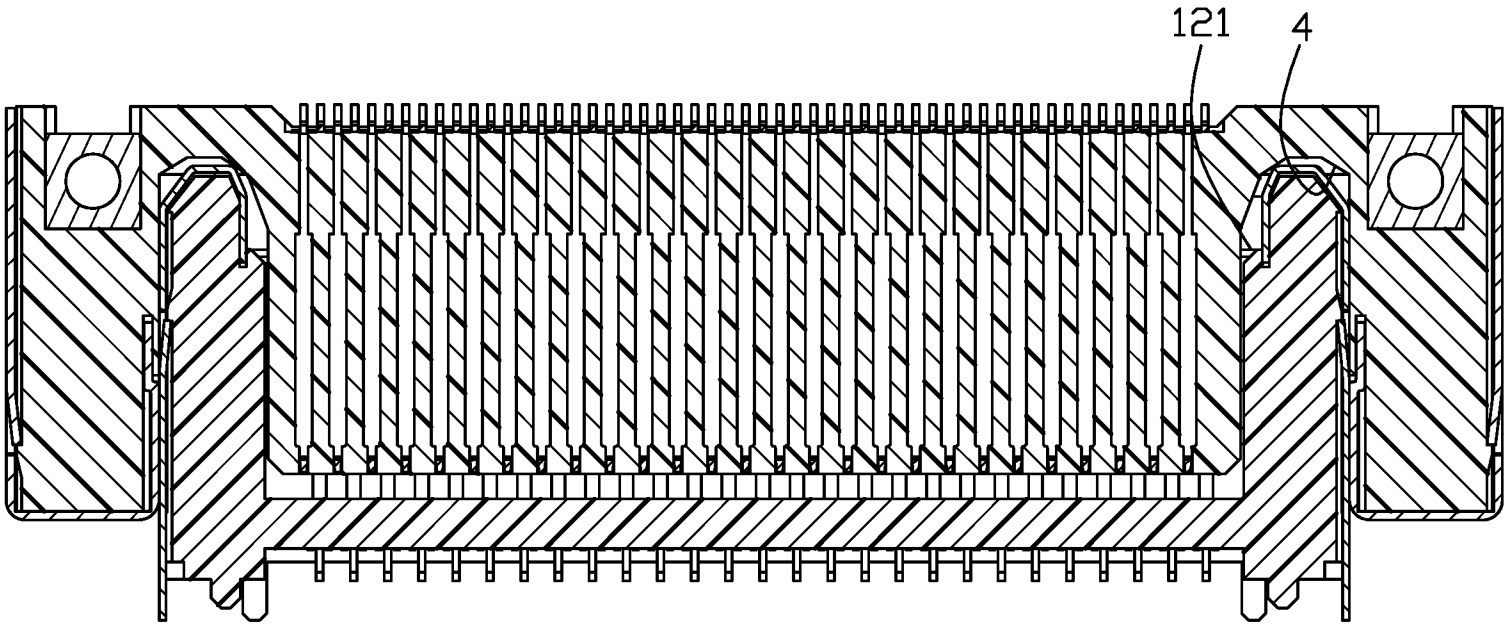
FIG. 12(B) is a cross-sectional view of the plug connector and the receptacle connector of the electrical connector assembly of FIGS. 1 and 6 at a final stage during mating.

Compared with the traditional design, in the plug connector 1, the free end of the bending section 34 is protectively hidden within the recess 150 behind the mating face 121 in the front-to-back direction while the forward apex is received within the corresponding recession 410 wherein the bending section 34 covers an interior surface of the guiding post 15. The end plate 31 intimately confronts the corresponding bending section 65 in the longitudinal direction. Similarly, in the receptacle connector 2, the free end of the bending section 65 is protectively embedded within the corresponding recess 430 via the offset structure, and the bending section 65 covers an interior surface of the corresponding end wall 43. As shown in FIGS. 12(A) and 12(B), the plug connector 1 can be stably and reliably plugged into the mating cavity 61 of the receptacle connector 2, and the mating tongue 42 is received within the receiving space 122 of the plug connector 1.

What is claimed is:

1. An electrical assembly comprising:

a plug connector and a receptacle connector adapted to be mated with each other, said plug connector including:

an insulative housing forming a receiving space behind a forward mating face in a front-to-back direction, and a pair of guiding posts located by two sides of the receiving space along a longitudinal direction perpendicular to the front-to-back direction, each guiding post forwardly extending beyond the mating face;

a plurality of contacts disposed in the housing;

a metallic shield enclosing the housing and including a pair of end plates each being equipped with a bending section covering both opposite inner side region and outer side region of the corresponding guiding post with thereof a free end protectively embedded within a recess of the housing and located behind the mating face in said front-to-back direction.

2. The electrical assembly as claimed in claim 1, wherein said recess is formed within a corresponding end wall of the housing.

3. The electrical assembly as claimed in claim 2, wherein an exterior face of the end wall forms a long groove and a short groove, and the end plate forms a spring tang is engaged within the long groove.

4. The electrical assembly as claimed in claim 1, wherein said free end is equipped with barbed structures.

5. The electrical assembly as claimed in claim 1, wherein the receptacle connector includes an insulative body defining a mating tongue, a plurality of terminals retained in the housing and exposed upon the mating tongue, a metallic shell enclosing the body and defining a mating cavity in which the mating tongue extends in the front-to-back direction, said shell further defining a pair of end plates each having a bending section with an offset structure thereof so as to have an inner section protectively hidden under the body and an outer section fully exposed toward the mating tongue in the longitudinal direction.

6. The electrical assembly as claimed in claim 5, wherein during mating the outer section of the bending section of the end plate of the receptacle connector mechanically and electrically connects to the corresponding end plate of the plug connector.

7. The electrical assembly as claimed in claim 6, wherein the body of the receptacle connector forms a pair of recessions to receive the corresponding guiding posts of the plug connector, respectively.

8. The electrical assembly as claimed in claim 7, wherein the body of the receptacle connector forms a pair of grooves beside the corresponding recession in the longitudinal direction to receive a corresponding horizontal nut.

9. The electrical assembly as claimed in claim 8, wherein the grooves extend rearwardly while recession is exposed forwardly toward an exterior along the front-to-back direction.

10. The electrical assembly as claimed in claim 5, wherein during mating, the bending section of the end plate of the plug connector communicatively faces toward the mating tongue.

11. An electrical assembly comprising:

a plug connector and a receptacle connector adapted to be mated with each other, the receptacle connector including:

an insulative body forming a mating tongue and a pair of end walls by two sides of the mating tongue in a longitudinal direction;

a plurality of terminals retained in the body and exposed upon the mating tongue;

a metallic shell enclosing the body and defining a mating cavity in which the mating tongue extends forwardly in a front-to-back direction perpendicular to the longitudinal direction, and said shell further defining a pair of end plates each having a bending section with an offset structure thereof so as to have an inner section protectively hidden under the body and an outer section fully exposed toward the mating tongue in the longitudinal direction.

12. The electrical assembly as claimed in claim 11, wherein each end wall has a recess including an outer part to receive the outer section of the bending section, and an inner part to receive the inner section of the bending section.

13. The electrical assembly as claimed in claim 12, wherein the outer part includes an extending end behind a main portion of the outer part.

14. The electrical assembly as claimed in claim 11, wherein a free end of the bending section forms barbed structures.

15. The electrical assembly as claimed in claim 11, wherein the body of the receptacle connector forms a pair of recessions to receive corresponding guiding posts of the plug connector, respectively.

16. The electrical assembly as claimed in claim 15, wherein the body of the receptacle connector forms a pair of grooves beside the corresponding recession in the longitudinal direction to receive a corresponding horizontal nut.

17. The electrical assembly as claimed in claim 16, wherein the grooves extend rearwardly while the recessions are exposed to an exterior forwardly in the front-to-back direction.

18. The electrical assembly as claimed in claim 11, wherein the end wall forms a long groove and a short groove in an exterior face, and the end plate of the shell forms a spring tang engaged within the long groove.

* * * * *